US006084490A

United States Patent [19]

Azzi et al.

[11] Patent Number: 6,084,490

[45] Date of Patent: Jul. 4, 2000

[54] SADDLE SHAPED DEFLECTION WINDING HAVING A WINDING SPACE WITHIN A PREDETERMINED ANGULAR RANGE

[75] Inventors: Nacerdine Azzi, Genlis; Olivier Masson, Cuisery, both of France

[73] Assignee: Thomson Tubes & Displays, S.A., Boulogne, France

[21] Appl. No.: 09/319,759

[22] PCT Filed: Dec. 19, 1997

[86] PCT No.: PCT/EP97/07350

§ 371 Date: Jun. 10, 1999

§ 102(e) Date: Jun. 10, 1999

[87] PCT Pub. No.: WO98/28773

PCT Pub. Date: Jul. 2, 1998

[30] Foreign Application Priority Data

Dec. 20, 1996 [FR] France ..... 96 15732
May 2, 1997 [FR] France ..... 97 05473

[51] Int. Cl.[7] ..... H01F 7/00

[52] U.S. Cl. ..... 335/210; 313/440

[58] Field of Search ..... 335/210–213; 313/440–442

[56] References Cited

U.S. PATENT DOCUMENTS 4,464,643 8/1984 Merrshoek ..... 335/213
5,121,028 6/1992 Milili ..... 313/440
5,418,422 5/1995 Vink et al. ..... 313/440

FOREIGN PATENT DOCUMENTS 0366196 5/1990 European Pat. Off. ..... H01J 29/76
0425747 5/1991 European Pat. Off. ..... H01J 29/76
0436998 7/1991 European Pat. Off. ..... H01J 9/236
0540113 5/1993 European Pat. Off. ..... H01J 29/76
0569079 11/1993 European Pat. Off. ..... H01J 29/76

*Primary Examiner*—Lincoln Donovan
*Attorney, Agent, or Firm*—Joseph S. Tripoli; Joseph J. Laks; Sammy S. Henig

[57] ABSTRACT

An deflection yoke for a color cathode ray tube includes a saddle shaped vertical deflection coil and a saddle shaped horizontal deflection coil. The horizontal deflection coil includes winding turns forming a pair of side portions having a winding window therebetween extending free of conductor wires. Each of the side portions has first and second winding spaces. The first winding space forms an aperture occupying an angular range between 30 and 45 degrees and having a length dimension greater than one half a length dimention of the window. A corner portion of the second winding space is disposed in a Z-axis coordinate selected in a range between a Z-axis coordinate of an end of the window, close to the electron gun of the tube, and a Z-axis coordinate, closer to the screen of the tube. The length of the range is approximately 10% of a length of the window. Correction of convergence error, horizontal coma error, coma parabola error and trapezium error is obtained without using field shapers such as shunts or magnets.

12 Claims, 7 Drawing Sheets

SADDLE SHAPED DEFLECTION WINDING HAVING A WINDING SPACE WITHIN A PREDETERMINED ANGULAR RANGE

The invention relates to a deflection yoke for a color cathode ray tube (CRT) of a video display apparatus.

BACKGROUND

A CRT for generating color pictures generally contains an electron gun emitting three coplanar beams of electrons (R, G and B electron beams), to excite on a screen a luminescent material of a given primary color red, green, and blue, respectively. The deflection yoke is mounted the neck of the tube for producing deflection fields created by the horizontal and vertical deflection coils or windings. A ring or core of ferromagnetic material surrounds, in a conventional way the deflection coils.

The three beams generated are required to converge on the screen for avoiding a beam landing error called convergence error that would otherwise produce an error in the rendering of the colors. In order to provide convergence, it is known to use astigmatic deflection fields called self-converging. In a self-converging deflection coil, the field nonuniformity that is depicted by lines of flux generated by the horizontal deflection coil has generally pincushion shape in a portion of the coil situated in the front part, closer to the screen.

A geometry distortion referred to as pincushion distortion is produced in part because of the non-spherical shape of the screen surface. The distortion of the picture, referred to as North-South at the top and bottom and East-West at the side of the picture, is stronger as the radius of curvature of the screen is greater.

A coma error occurs because the R and B beams, penetrating the deflection zone at a small angle relative to the longitudinal axis of the tube, undergo a supplementary deflection with respect to that of the center G beam. With respect to the horizontal deflection field, coma is generally corrected by producing a barrel shape horizontal deflection field at the beam entrance region or zone of the deflection yoke, behind the aformentioned pincushion field that is used for convergence error correction.

A coma parabola distortion is manifested in a vertical line at the side of the picture by a gradual horizontal direction shift of the green image relative to the mid-point between the red and blue images as the line is followed from the center to the corner of the screen. If the shift is carried out toward the outside or side of the picture, such coma parabola error is conventionally referred to as being positive; if it is carried out toward the inside or center of picture, the coma parabola error is referred to as being negative.

A horizontal trapezium error occurs due to the astigmatism of the field. When the image to be displayed is a rectangular test pattern, this error is manifested on the tube screen by a blue image which, for example, has rotated with respect to the red image, as illustrated in FIG. 6*a*. The horizontal trapezium error occurs because the conductors making up the horizontal deflection coils, having a winding distribution chosen to optimize other parameters (convergence, geometry, etc.), may produce high-order deflection field coefficients or harmonics that produce trapezium differentials. The trapezium differentials may result in, for example, a slope inversion of the blue image between the point at 1 H (one o'clock on the screen) and the point representing the corner of the image at 2 H (two o'clock on the screen), as illustrated in FIG. 6*b*.

It is common practice to divide the deflection field into three successive action zones along the longitudinal axis of the tube: the back or rear zone, closest to the electron gun, the intermediate zone and the front zone, closest to the screen. Coma error is corrected by controlling the field in the rear zone. Geometry error is corrected by controlling the field in the front zone. Convergence error is corrected in the rear and intermediate zones and is least affected in the front zone.

For example, in the prior art deflection yoke of FIG. 2, permanent magnets 240, 241, 242 are positioned in front of the deflection yoke to reduce geometry distortions. Other magnets 142 and field shapers are inserted between the horizontal and vertical deflection coils to modify locally the field to reduce coma, parabola coma, and convergence errors.

When the screen has a relatively large radius of curvature greater than 1R, such as 1.5R or more, for example, it becomes more and more difficult to solve the beam landing errors previously described without utilizing magnetic helpers such as shunts or permanent magnets.

It may be desirable reduce error such as the trapezium error, coma parabola error, coma error or convergence error by controlling the winding distributions of the deflection coils without utilizing magnetic helpers such as shunts or permanent magnets.

Eliminating the shunts or permanent magnets is desirable because, disadvantageously, these additional components may produce a heating problem in the yoke related to higher horizontal frequency, particularly when the horizontal frequency is 32 kHz or 64 kHz and more. These additional components may also, undesirably, increase variations among the produced yokes in a manner to degrade the corrections of trapezium, geometry, coma, coma parabola and convergence errors.

SUMMARY

In a video display, embodying an inventive feature, a saddle shaped, deflection coil produces a deflection field to scan an electron beam along a first axis of a display screen of a cathode ray tube. The deflection coil includes winding turns forming a pair of side portions, a front end turn portion, close to the screen, and a rear end turn portion, close to an electron gun of the tube. The side portions form a winding window free of conductor wires therebetween having a length dimension defined by a distance between the front end turn portion and the rear end turn portion. At least one of the side portions has a winding space for correcting a beam landing error. The first winding space forms an aperture occupying an angular range selected between 30 and 45 degrees and having a length dimension greater than one half the length dimention of the window.

Advantageously, forming the winding space in the angular range between 30 and 45 degrees reduces the aforementioned trapezium error. The reduction of the trapezium error is obtained without using any shunt or magnet in the yoke.

DESCRIPTION OF THE PREFERRED EMBODIMENTS

Figure 1:
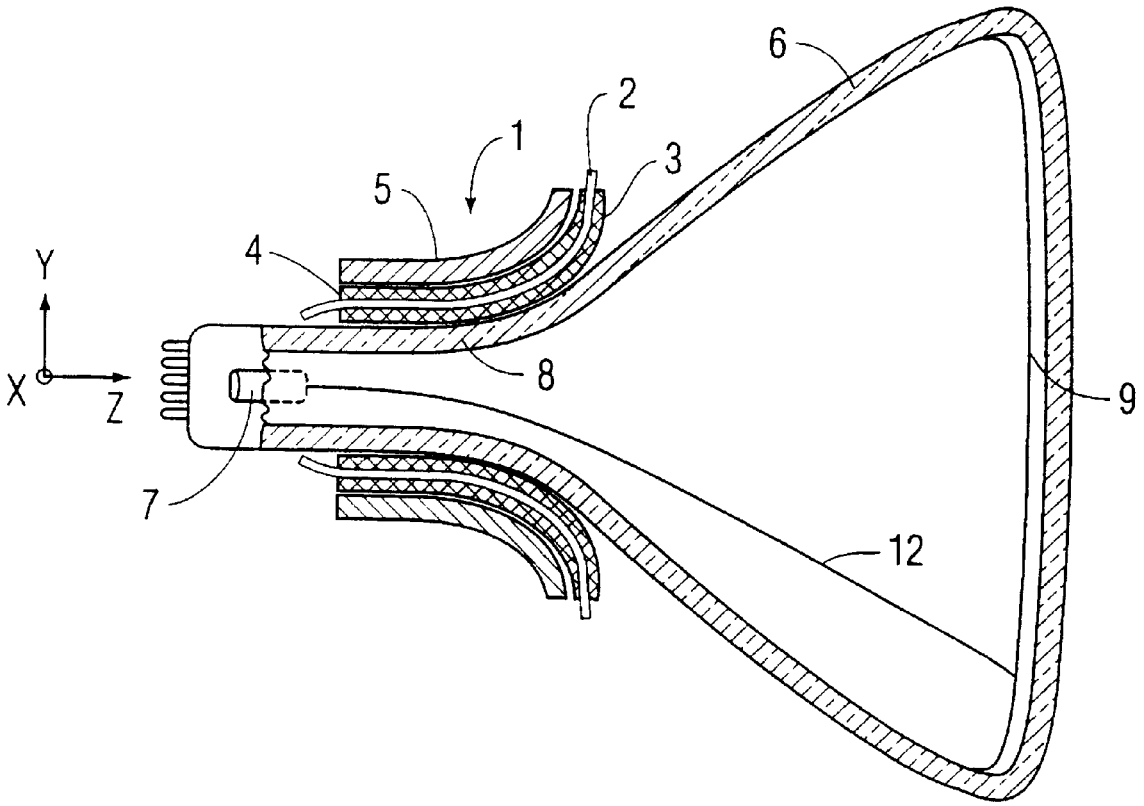
FIG. 1 illustrates a deflection yoke, according to an inventive arrangement mounted on a cathode ray tube.
Figure 2:
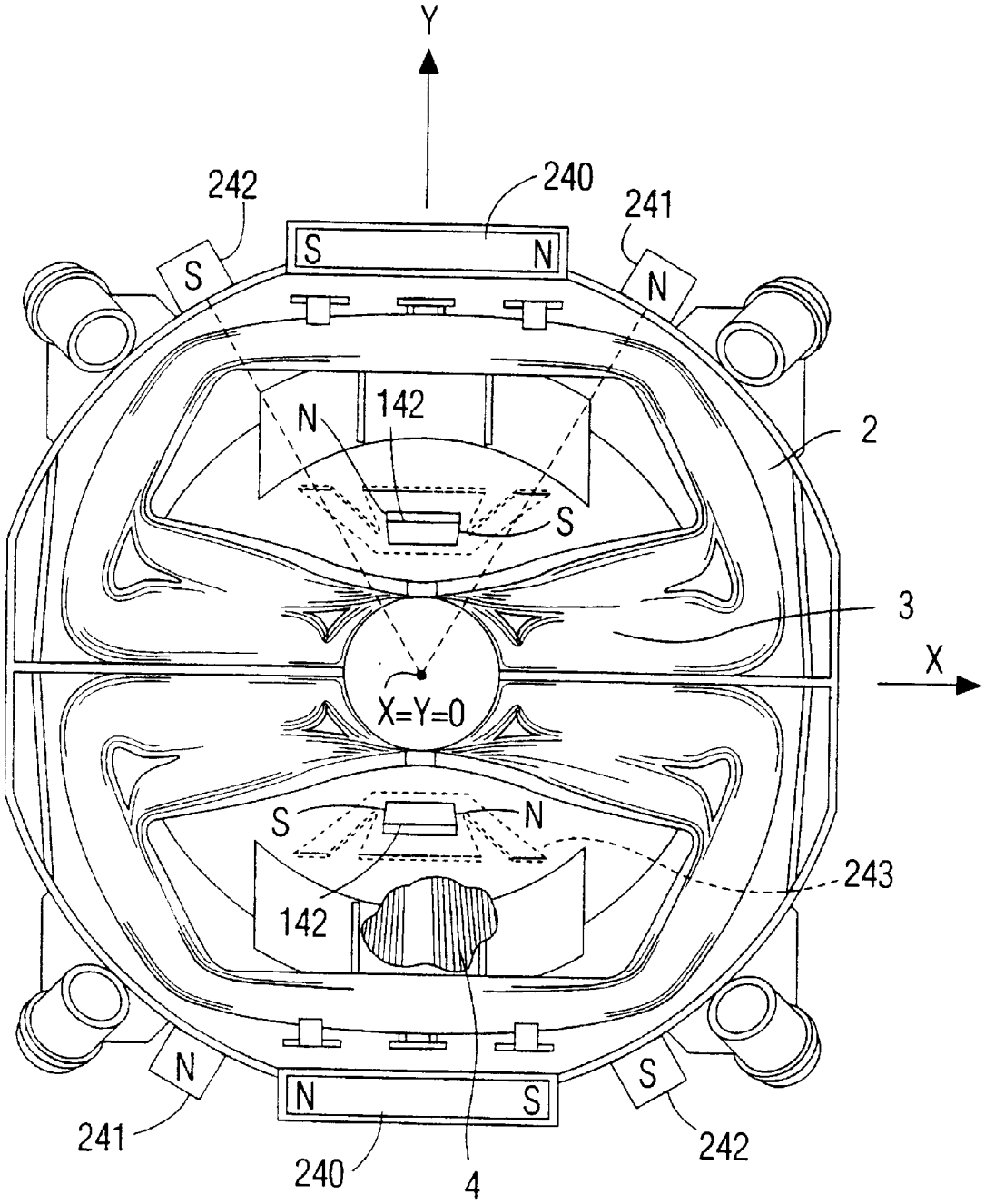
FIG. 2 PRIOR ART
FIG. 2 illustrates a frontal, exploded view of a deflection yoke according to the prior art.

As illustrated in FIG. 1, a self-converging color display device includes a cathode ray tube (CRT) having an evacuated glass envelope 6 and an arrangement of phosphorous or luminescent elements representing the three primary colors R, G and B arranged at one of the extremities of the envelope forming a display screen 9. Electron guns 7 are arranged at a second extremity of the envelope. The set of electron guns 7 is arranged so as to produce three electron beams 12 aligned horizontally in order to excite corresponding luminescent color elements. The electron beams sweep the surface of the screen by the operation of deflection yoke 1 mounted on a neck 8 of the tube. Deflection yoke 1 includes a pair of horizontal deflection coils 3, a pair of vertical deflection coils 4, isolated from each other by a separator 2, and a core of ferromagnetic material 5 provided to enhance the field at the beam paths.

Figure 4A:
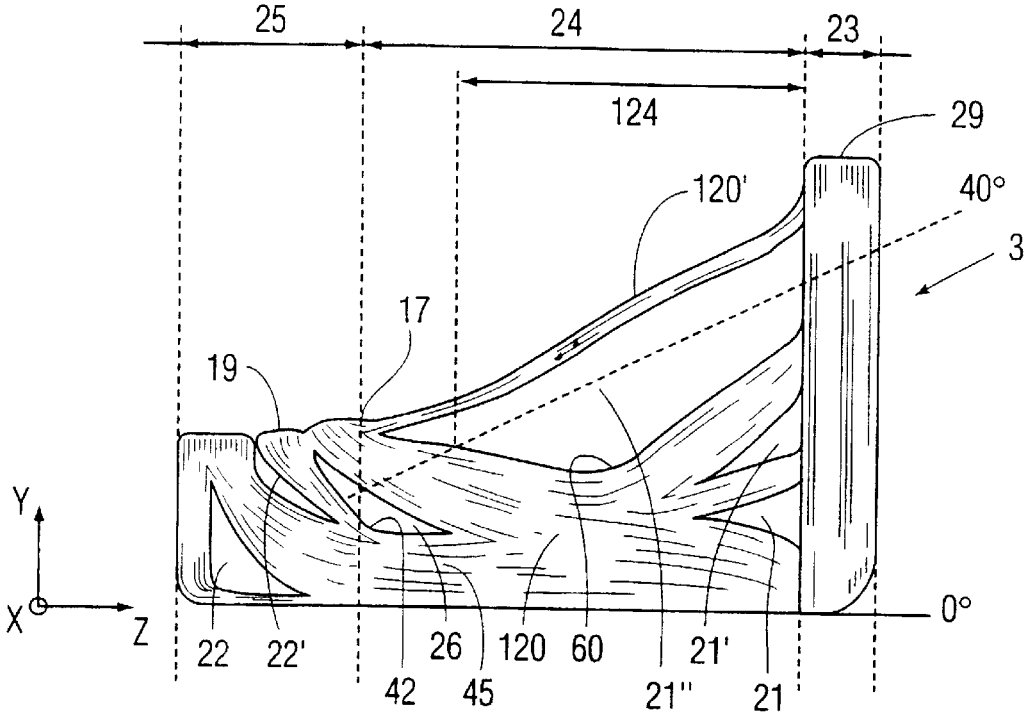
FIGS. 4*a* and 4*b* represent a side view and a top view, respectively, of a coil according to an inventive arrangement.
Figure 4B:
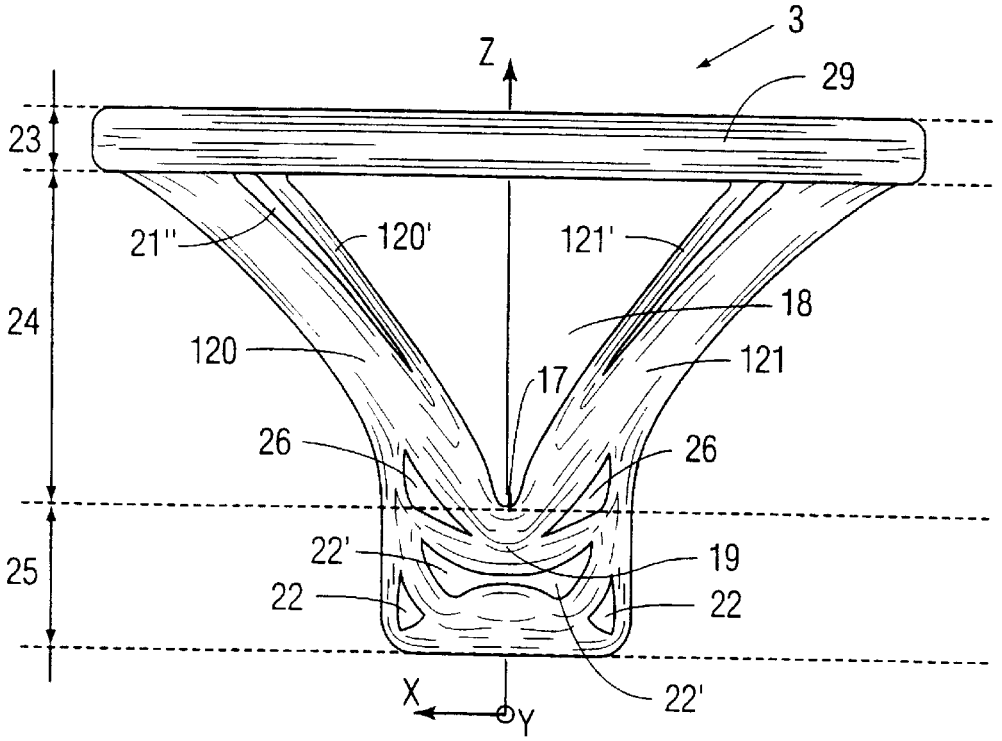

FIGS. 4*a* and 4*b* illustrate, respectively, the side and top views of one of the pair of horizontal coils or windings 3 having a saddle shape, in accordance with an aspect of the invention. Each winding turn is formed by a loop of a conductor wire. Each of the pair of horizontal deflection coils 3 has a rear end turn portion 19, near the electron guns 7 of FIG. 1, and extending along the longitudinal or Z axis. A front end turn portion 29 of FIGS. 4*a* and 4*b*, disposed close to display screen 9 of FIG. 1, is curved away from the Z axis in a direction generally transverse to the Z axis. Each of core 5 and separator 2 may, advantageously, be fabricated in the form of a single piece rather than being assembled from two separate pieces.

The conductor wires of front end turn portion 29 of the saddle coil 3 of FIGS. 4*a* and 4*b* are connected to rear end turn portion 19 by side wire bundles 120, 120', forming together one side portion, along the Z axis, on the one side of the X axis, and by side wire bundles 121, 121', forming together the other side portion, on the other side of the X axis. The portions of side wire bundles 120, 120' and 121, 121' situated close to the deflection coil deflection magnetic field beam exit region 23 form front spaces 21, 21' and 21" of FIG. 4*a*. The front spaces 21, 21' and 21" affect or modify the current distribution harmonics so as to correct, for example, the geometric distortions of the image formed on the screen such as the north-south distortion. Likewise, the portions of side wire bundles 120, 120' and 121, 121' situated in the entrance region 25 of deflection coil 3 form back spaces 22 and 22'. Spaces 22 and 22' have winding distributions selected for correcting the horizontal coma errors. End turn portions 19 and 29 as well as side wire bundles 120' and 121' define a main winding window 18.

The region along the longitudinal Z-axis of end turn portion 29 defines beam exit zone or region 23 of coil 3. The region along the longitudinal Z-axis of window 18 defines an intermediate zone or region 24. Window 18 extends, at one extreme, from the Z-axis coordinate of a corner portion 17 in which side wire bundles 120' and 121' are joined. The other extreme of window 18 is defined by portion 29. The zone of the coil situated in rear behind window 18 including rear end turn 19 is referred to as the beam entrance region or zone 25.

Coma error are corrected mainly in the rear or entrance zone 25. Geometry errors such as East-West and North South distortions are mainly corrected at or near exit zone 23. Convergence error is least affected in the exit zone 23 and is mainly corrected in intermediate zone 24 and entrance zone 25.

Figure 3:
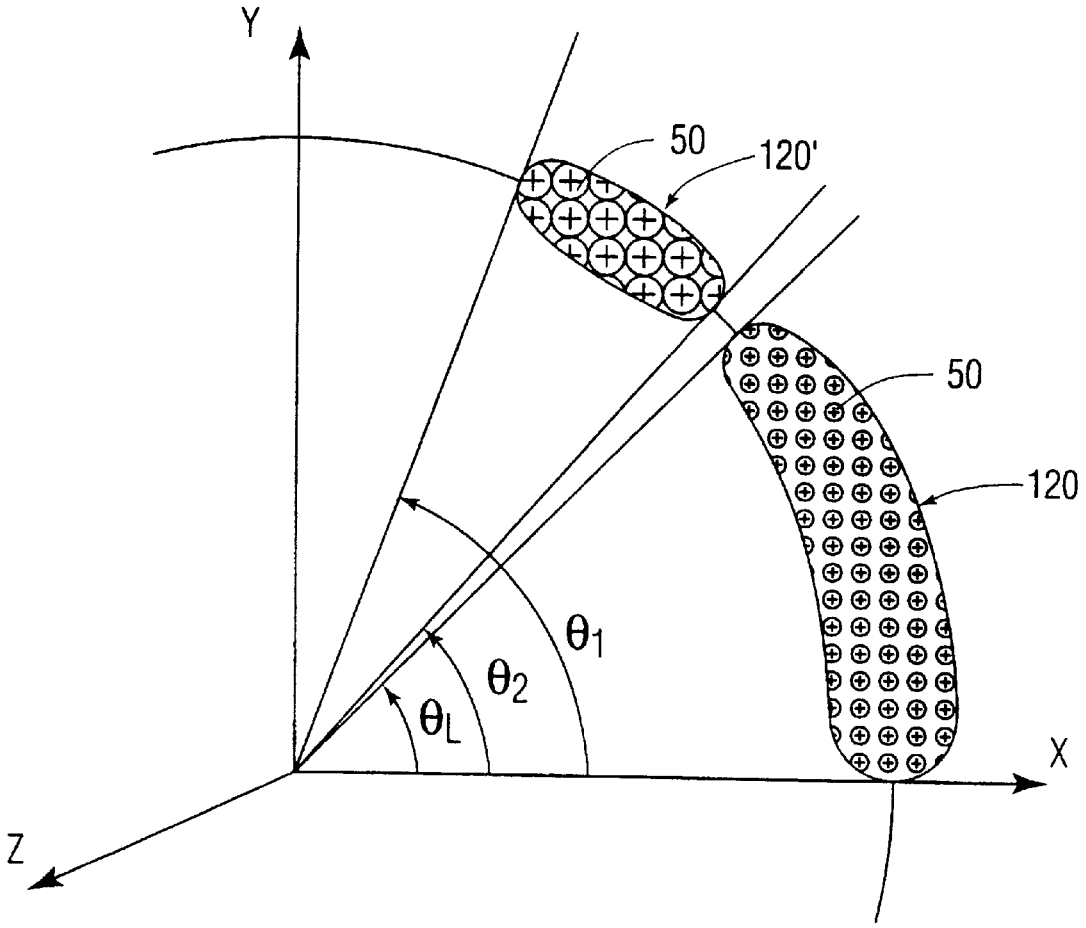
FIG. 3 shows a cross section of a saddle coil according to an inventive arrangement formed in the intermediate zone of the coil.

FIG. 3 is a cross sectional view of saddle line coil 3 in a plane parallel to XY in intermediate zone 24. For symmetry consideration, the cross section of only one half of the coil is represented. This half coil includes bundles 120, 120' of conductors 50. The position of each conductor is identified by its radial angular position θ. The condutor wires of group 120 are arranged between zero degrees and $\theta_L$ while those of the group 120' are arranged between θ1 and θ2.

Because of symmetry consideration of the windings, the Fourier series expansion of the ampere turn density N(θ) of a coil is written:

$$N(\theta)=A1\cdot\cos(\theta)+A3\cdot\cos(3\theta)+A5\cdot\cos(5\theta)+\ldots+AK\cdot\cos(K\theta)+ \quad \text{(EQ1)}.$$

$$\text{with: } AK=(4/\pi)\cdot\int_0^{\pi/2}N(\theta)\cdot\cos(K\theta)\cdot d\theta \quad \text{(EQ2)}$$

The magnetic field is expressed by:

$$H=A1/R+(A3/R^3)\cdot(X^2-Y^2)+(A5/R^5)\cdot(X^4-6X^2\cdot Y^2+Y^4)+ \quad \text{(EQ3)}$$

where R is the radius of the magnetic circuit of the ferrite core surrounding the deflection coils. The term A1/R represents the zero order coefficient or fundamental field component of the field distribution function, the term $(A3/R^3)\cdot(X^2-Y^2)$ represents the second order coefficient of the field distribution function in a point of coordinates X and Y and is related to the third harmonic of the winding distribution. The term $(A5/R^5)(X^4-6X^2\cdot Y^2+Y^4)$ represents the fourth order coefficient of this field or fifth harmonic, etc.

A positive term A3 corresponds to a second order coefficient of the positive field on the axis that produces pincushion shaped field. In the case where the current circulates in the same direction in all of the conducting wires, N(θ) is conventionally positive, and the term A3 is positive if the wires are arranged between θ=zero degrees and θ=30 degrees. This is so because cos(3θ) is positive. By arranging the wires in the angular range previously defined it is possible to introduce locally a significant positive second order coefficient of the field as well as a positive fourth order coefficient of the field that is positive overall.

In order to maintain the convergence of the electron beams coming from an in-line gun, it is known to make the second order coefficient of the line deflection field positive in the intermediate zone 24. For this porpose, a majority of wires of side bundles 120, in at least one part of the intermediate zone 24, is kept in a radial angular position ranging between 0 degrees and 30 degrees. However, because this method of controlling the convergence of the beams introduces a strong coma parabola error, the coma parabola error has to be corrected, as explained later on.

The saddle coil of FIGS. 4*a* and 4*b* may be wound with a copper wire of small dimensions covered with an electrical insulation and with a thermosetting glue. The winding is carried out in a winding machine which winds the saddle coil essentially according to its final shape and introduces spaces 21, 21', 21", 22, 22' of FIGS. 4*a* and 4*b* during the winding process. The shapes and placements of these spaces are determined by retractable pins in the winding head which limit the shapes of these spaces by forming a corner portion in each space.

After the winding, each saddle coil is kept in a mold and a pressure is applied to it in order to obtain the required mechanical dimensions. A current passes through the wire in order to soften the thermosetting glue which is then cooled again in order to glue the wires to each other and to form a saddle coil which is self supporting.

The placement of space 21" formed in the intermediate region 24 is determined, during the winding process, by a pin at a position 60 of FIG. 4*a* located in the center region of intermediate region 24. The result is that a corner section or portion is formed at position 60 of space 21".

The pin produces an abrupt change in the winding distribution and forms the corresponding corner portion in the winding space, in a well known manner. On the side of position 60 of FIG. 4*a* that is closer to the entrance zone, the closer it is to corner position 60, the greater is the concentration of the wires. On the other hand, on the side of corner position 60 that is closer to the exit zone, the concentration of the wires decreases, as the distance from position 60 increases. Thus, the concentration of the wires is at a local maximum at position 60.

The placement of a space 26 formed in the back portion of intermediate region 24 is determined, during the winding process, by a pin at a position 42 located in the back portion of intermediate region 24. The result is that a corner section is formed at position 42 of space 26. Location 42 is situated, with respect to the Z axis, at 56 mm from the front of the coil, close to a back limit or corner portion 17 of main window 18. Back end portion 17 defines the furthest coordinate in the Z axis of window 18 from the front of the coil. Corner portion 17 is situated with respect to the Z axis at a distance of 59 mm from the front of the coil. Space 26 extends along the Z axis between 47 mm and 62 mm from the front of the deflection coil.

Both spaces 21" and 26 are located in the side portion formed by bundle of wires 120 and 120". The pin at position 60 is situated close to the center of the intermediate zone 24. The pin at position 42 is situated in a rear portion of the intermediate zone, close to corner portion 17.

Advantageously, position 42 is selected within a range that is bound, at one end, by a Z axis coordinate of corner portion 17 of window 18, and, at the other end, by a Z axis coordinate at a distance from corner portion 17 approximately 10% of the length of intermediate zone 24. The length of intermediate zone 24 is equal to the difference between the boundary Z axis coordinate of window 18 formed by end turn section 29 and the Z axis coordinate of corner portion 17 of window 18. Selecting the coordinate of position 42 within such range of 10% of the length of the intermediate zone provides improved coma parabola correction. It also avoids using shunts or magnets.

For analysis purposes, the values of the errors of convergence and of coma of a conventional or classical first coil, in which the side wire bundles are arranged with an essentially constant radial density, between 0 degrees and 50 degrees, were compared with those of a hypothetical second coil that is similar in some respects to the coils of FIGS. 4*a* and 4*b*. In the second coil, 94% of the side wire bundles, in a longitudinal position essentially in the middle of the intermediate zone 24, are concentrated in a radial opening ranging between 0 degrees and 31 degrees, thus creating a lateral winding space in the winding analogous to lateral winding space 21" of FIG. 4*a*. Additionally, the values of convergence and of coma of the classical first coil, in which the side wire bundles are arranged with an essentially constant radial density, between 0 degrees and 50 degrees, were compared with those of a hypothetical, third coil. In the third coil, 49% of the side wire bundles in a longitudinal position located in the rear of the intermediate zone 24, are concentrated near the entrance zone 25, in a radial opening ranging between 0 degrees and 33 degrees, thus creating a lateral winding space in the winding similar to lateral winding space 26 of FIG. 4*a*.

The following table demonstrates an improvement in both the second and third coils relative to the classical or conventional first coil with respect to convergence and of coma errors but a degradation of the coma parabola error. The coma parabola error increases from 0.44 mm to 0.83 mm, in the second coil, and to 0.53 mm, in the third coil.

In the following table, the errors of coma (horizontally and vertically) and of convergence are measured at nine points, conventionally representative of a quadrant of the screen of a cathode ray tube. As can be noted, the two modified structures of the second and third coils modify the coma parabola in opposite directions. Advantageously, this feature is used in the arrangement of FIGS. 4*a* and 4*b* to reduce the coma parabola error value to an acceptable value, close to zero.

| | Blue/red convergence | | | Green horizontal coma relative to the red/blue average | | | Coma parabola error |
|---|---|---|---|---|---|---|---|
| Without spaces 21" and 26 | 0.40 | 0.54 | 3.18 | 0 | 1.07 | 3.44 | 0.44 |
| | 0.20 | 1.76 | 9.21 | 0 | 1.13 | 3.42 | |
| | 0 | 1.89 | 9.80 | 0 | 1.10 | 3.00 | |
| With space 21" | 0.42 | 0.41 | 1.22 | 0 | 0.71 | 1.89 | −0.83 |
| | 0.19 | 0.89 | 4.24 | 0 | 0.77 | 2.45 | |
| | 0 | 0.97 | 5.74 | 0 | 0.80 | 2.72 | |
| With space 26 | 0.35 | 0.35 | 1.30 | 0 | 0.28 | 0.96 | 0.53 |
| | 0.15 | 0.87 | 4.97 | 0 | 0.18 | 0.62 | |
| | 0 | 0.74 | 4.22 | 0 | 0.11 | 0.43 | |

Advantageously, the placement of the corresponding pins associated with spaces 21" and 26 provides separate control parameters or degrees of freedom for correcting convergence and residual coma error while making it possible to minimize to an acceptable value the coma parabola error. Additionally, the usage of the combination of winding space 21", formed in bundle 120 in intermediate region 24, and of a winding space formed in region 25, provides the required variations along the Z axis such that the use of any shunts or magnets is, advantageously, avoided.

In the example of FIGS. 4*a* and 4*b*, the deflection yoke is mounted on a tube of the type A68SF having a screen of the aspherical type and a radius of curvature on the order of 3.5R in the horizontal edges. The horizontal coil 3 has a total length along the Z axis that is equal to 81 mm. The horizontal coil 3 has front or beam exit region or zone 23 formed by end turn wire of 7 mm length along the Z axis. The horizontal coil 3 has intermediate zone 24 of length 52 mm in which window 18 of FIG. 4*b* extends. The horizontal coil has back or rear end turn wire 19 which extends to a length along the Z axis of 22 mm. The wires at the back of the coil are wound so that they constitute several bundles or groups locally separated from each other by spaces free of wires.

As can be seen by examining the coil of FIGS. 4*a* and 4*b* along its YZ plane of symmetry, in zone 24, spaces 21" and 26 are created by the insertion of pins at locations 60 and 42 during the winding process, as indicated before. The pin at position 60 maintains the bundle of wires 120 to approximately 94% of the number of wires of the coil. The pin at position 60 is located at a distance of 27 mm from the front of the coil, approximately at the center of the intermediate region 24, in an angular position in the XY plane of 31.5 degrees. The pin at location 42 maintains the bundle of wires 45 of FIG. 4*a* to approximately 49% of the number of wires of the coil. The pin at position 42 is arranged at 56 mm from the front of the coil in an angular position in the XY plane that is equal to 33 degrees.

The majority of the geometry errors are corrected by the arrangement of wires in the exit zone 23. The coma errors are partially corrected by winding spaces formed in the wires in rear end turn portion 19 of beam entrance zone 25.

In the arrangement of FIGS. 4*a* and 4*b,* the convergence errors and residual coma errors are partially corrected by the operation of a portion of the wires in the intermediate zone established by the pin at position 60 and by the operation of a portion of the wires in the intermediate zone established by the pin at position 42. Each of the corrections contributes partially to the reduction of the convergence and coma errors.

Advantageously, the aforementioned convergence and coma error corrections produce variations in the coma parabola errors in opposite directions to each other. Therefore, advantageously, the coma parabola error can be minimized to an acceptable magnitude.

Figure 5A:
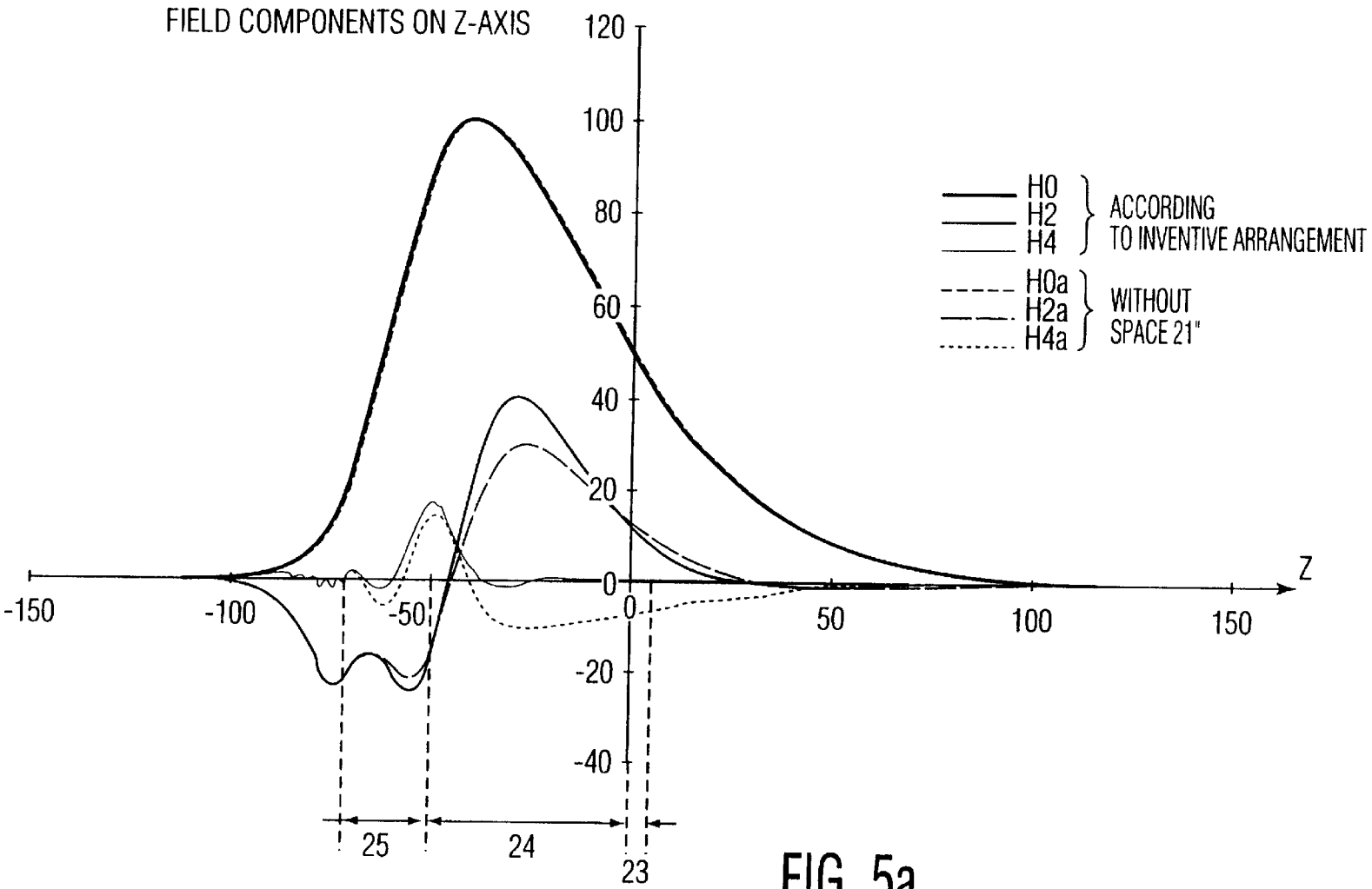
FIGS. 5*a* and 5*b* show the variation along the main axis Z of the tube, of the horizontal deflection field distribution function coefficients generated by a coil according to an inventive arrangement and the influence of a winding window and winding spaces formed in the coil.
Figure 5B:
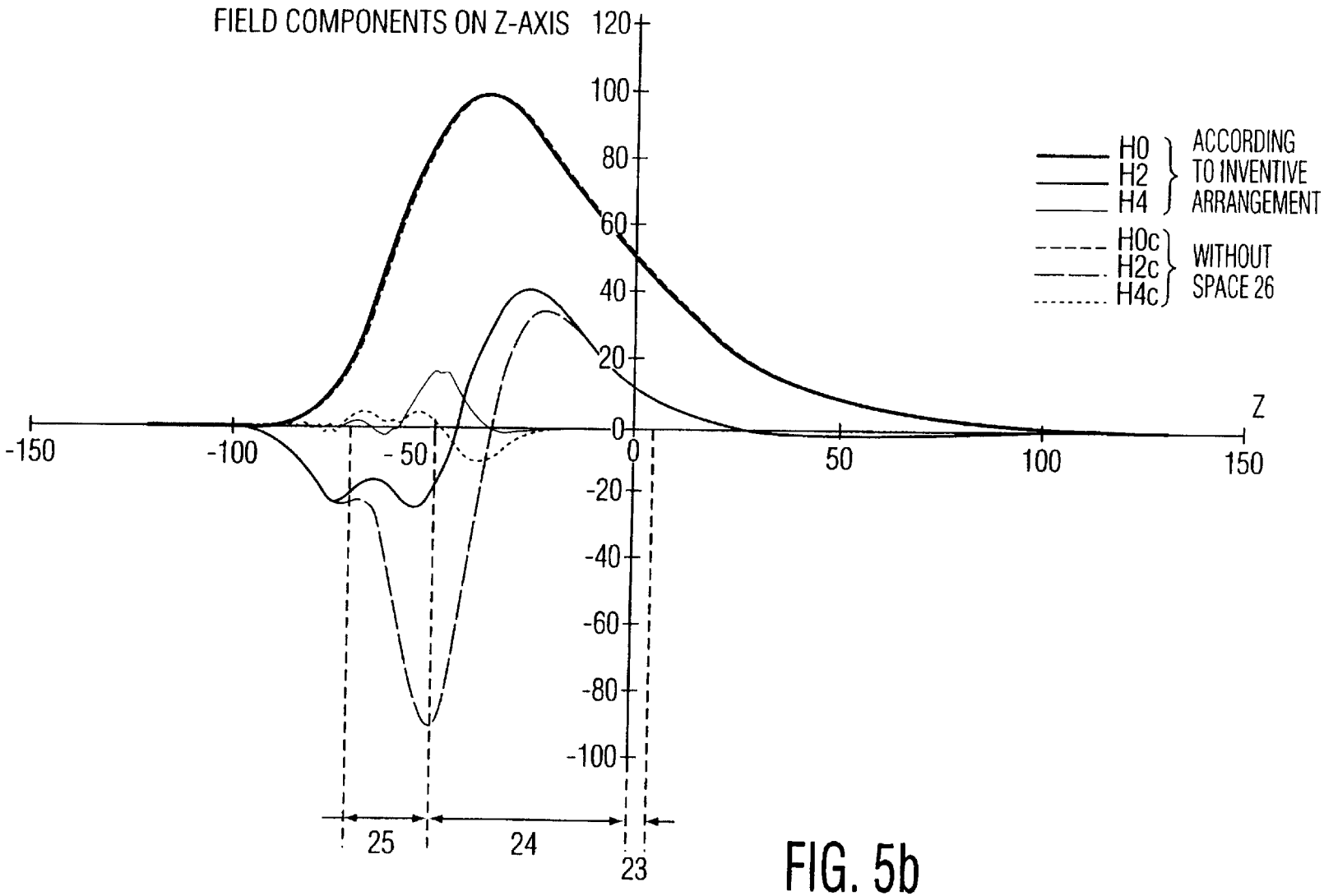

FIGS. 5*a* and 5*b* illustrate the influence of spaces 21" and 26 on the zero and higher order component coefficients of the horizontal deflection field. In FIG. 5*a,* the variation along the Z axis of the zero order component coefficient H0 of the field and the second and fourth order component coefficients H2 and H4 of the field produced by the coil of FIGS. 4*a* and 4*b* are provided, and can be compared to variation occurring in a similar coil but without space 21". In FIG. 5*b,* the variation along the Z axis of the zero order component coefficient of the field H0 and the second and fourth order component coefficients H2 and H4 of the field of the coil of FIGS. 4*a* and 4*b* are provided and can be compared to variation occurring in a similar coil but without space 26. As demonstrated in FIGS. 5*a* and 5*b,* each of spaces 21" and 26 increases positively the second and fourth order component coefficients in the zone of action without affecting the zero order component coefficient of the deflection field.

Depending on the size of the tube and the flatness of the screen, it may be desirable to create an additional space in the center region of zone 24 to attain the desired corrections. Likewise, the percentages of wire maintained in the radial opening between 0 to 30 degrees by the operation of the pins at locations 60 and 42, as well as the Z position of the pins, depends upon the shape of the field created by the selected shape of the wires in the zones 23 add 25. Thus, for example, it may be useful for a given action on the convergence of the beams to vary the fourth order component coefficient of the field by extending space 26 more or less in the back zone 25 so as to vary the effect on the coma and coma parabola errors.

The following table shows the values of the convergence, coma, and coma parabola errors resulting from the operation of the coil structure of FIGS. 4*a* and 4*b.* The values obtained for convergence, coma, and coma parabola errors are sufficiently low and, therefore, acceptable. (values in mm)

| BLUE/RED CONVERGENCE | | | GREEN/RED HORIZONTAL COMA | | | COMA PARABOLA ERROR |
|---|---|---|---|---|---|---|
| 0.40 | 0.19 | 0.49 | 0 | 0.03 | 0.11 | −0.01 |
| 0.17 | 0.28 | 0.65 | 0 | −0.02 | 0.01 | |
| 0 | 0.14 | 0.93 | 0 | 0.04 | 0.12 | |

The relative percentage of wires which the pin at location 42 maintains below a certain angular position in the XY plane, the position according to Z axis of the pin at location 42 and the angular position of the pin at location 42 may vary according to the extent of errors to be corrected. The size of space 26 may vary and may extend, as is the case in FIGS. 4*a* and 4*b,* to the entrance region 25.

The classical or conventional first coil, referred to before, may have a trapezium differential beam landing error, as indicated in the following table. The following table provides the trapezium values between the red image and the blue image at nine conventional points on the tube screen.

| | | |
|---|---|---|
| 0 | 0.24 | −0.62 |
| 0 | 0.26 | 0.3 |
| 0 | 0 | 0 |

Figure 6A:
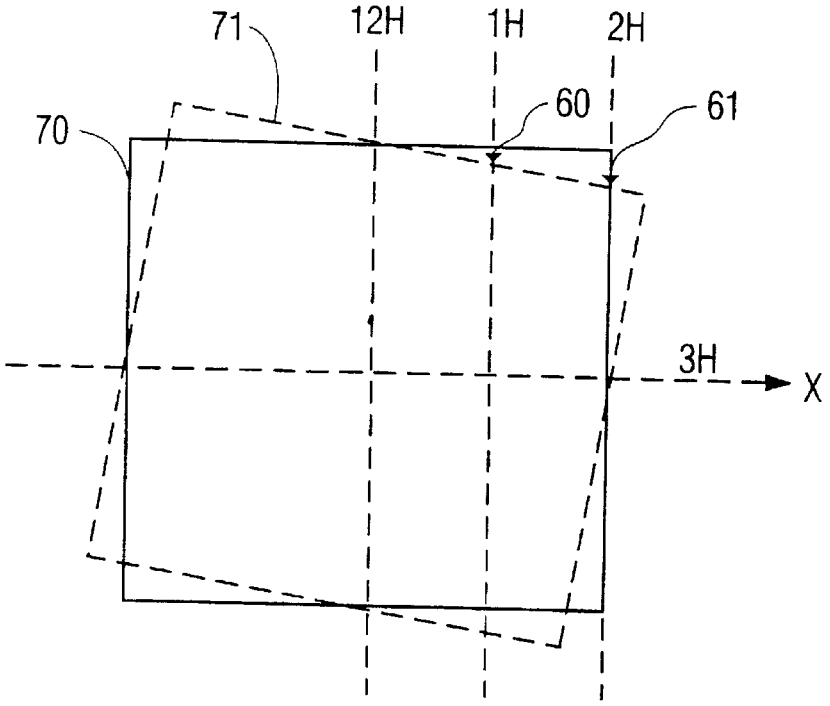
FIGS. 6*a* and 6*b* represent two types of trapezium beam landing errors between the red and blue images.
Figure 6B:
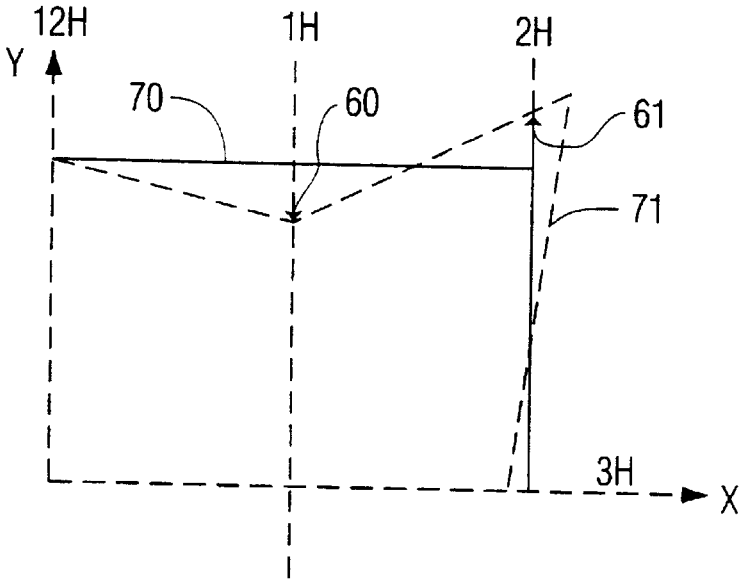

The trapezium differential error is illustrated in FIG. 6*b.* In FIG. 6*b,* the following reference numerals are applicable: 70 represents the red image, 71 represents the blue image, 60 represents the trapezium error at 1H (one o'clock on the screen) and 61 represents the trapezium error in the corner at the point 2H (two o'clock on the screen).

In carrying out an inventive feature, the trapezium differential errors are corrected by conductor-free space 21". Space 21" extends into the intermediate zone 24 over a length, in the direction of the Z axis, that is greater than half of the length, along the Z axis, of the intermediate zone 24. The length of the intermediate zone is equal to the length of window 18. Space 21" extends within a radial angular aperture in the X-Y plane selected between 30 and 45 degrees in order to minimize the influence of the high-order field distribution coefficients that could cause the trapezium differential problems. It was found that a radial direction of 40 degrees was the preferred direction for this type of tube in order to minimize the trapezium differential problems, so that the space 21" is generally oriented in this direction over the greater part of its length along the Z axis. In order to take into account the winding constraints of the line coil within a coil mold, the space 21" extends along the Z-axis over a length 124 so as to be free of conductors within a radial angular aperture that includes the 40 degree radial direction, as illustrated in FIG. 4*a.* Length 124 is equal to approximately 75% of the length along Z of the intermediate zone 24.

The measurements of the red/blue trapezium errors show a marked improvement in this case, which brings the trapezium differential to acceptable values. These values are given in the table below:

| | | |
|---|---|---|
| 0 | 0.13 | −0.18 |
| 0 | 0.25 | 0.21 |
| 0 | 0 | 0 |

In a mode of implementation not shown, two spaces can be formed in the side wire bundles situated according to the Z axis in the zone near the corner portion 17 of the main window 18. These two spaces may extend partially both into the zone 24 and into the zone 25. By positioning the pins making these windows during the winding process in different angular positions, it is possible to create groups of wires wherein the number of wires may vary in relative value which permits changing the effect created on the field and obtaining a finer action on zero and higher order component coefficients of the deflection field in order to minimize the errors of coma, coma parabola, and convergence.

The previously described implementation examples are not limiting. The same principle of implementation of a saddle shaped vertical deflection coil may be applied to modify the vertical deflection field in order to minimize the residual errors of convergence, of coma, and of vertical coma parabola.

What is claimed is:

1. A video display deflection apparatus, comprising:

a first deflection coil for producing a first deflection field to scan an electron beam along a first axis of a display screen of a cathode ray tube;

a saddle shaped, second deflection coil for producing a second deflection field to scan said electron beam along a second axis of said display screen of said cathode ray tube, said second deflection coil including a plurality of winding turns forming a pair of side portions, a front end turn portion, close to said screen, and a rear end turn portion, close to an electron gun of said tube, said side portions forming a winding window free of conductor wires between said side portions, having a length dimension defined by a distance between said front end turn portion and said rear end turn portion, at least one of said side portions having a first winding space for correcting a trapezium differential beam landing error, said first winding space occupying an angular range selected between 30 and 45 degrees and having a length dimension greater than one half said length dimension of said window, said angular range being measured in a plane that includes said first and second axes; and a magnetically permeable core for cooperating with said first and second deflection coils to form a deflection yoke.

2. A deflection appratus according to claim 1 wherein said first winding space reduces trapezium error.

3. A deflection apparatus according to claim 1 wherein said first winding space has a corner portion at a longitudinal coordinate, of a longitudinal axis that is perpendicular to said first and second axes closer to a longitudinal coordinate at a center of said window, between said front and rear end turn portions, than to each one of said front and rear end turn portions.

4. A deflection apparatus according to claim 3 wherein said first winding space extends from a longitudinal coordinate of said front end turn portion to a longitudinal coordinate, further from said screen than said window center coordinate.

5. A deflection apparatus according to claim 1 wherein said one side portion has a second winding space with a corner portion at a location selected from a range of longitudinal coordinates in a longitudinal axis that is perpendicular to said first and second axes, said range extending between a first longitudinal coordinate of a first end of said window, close to said rear end turn portion, and a second longitudinal coordinate, closer to said screen than said first end longitudinal coordinate at a distance from said first window end coordinate equal to 10% of said length dimension of said window.

6. A deflection apparatus according to claim 5 wherein said second winding space extends to a longitudinal coordinate further from said screen than said window first end coordindate.

7. A deflection apparatus according to claim 5 wherein said first and second winding spaces produce corresponding variations of a coma parabola error at opposite directions for compensating each other.

8. A deflection apparatus according to claim 5 wherein each of said winding spaces increases positively a second order coefficient and a fourth order coefficient of a field distribution function of a field of said first deflection coil.

9. A deflection apparatus according to claim 1 wherein said one side portion includes a first winding bundle having a second corner portion and including a majority of the wire conductors of said one side portion and a second winding bundle forming a side boundary of said winding window.

10. A deflection apparatus according to claim 9 wherein said first winding bundle that includes said second corner portion includes conductor windings between zero and 30 degrees.

11. A deflection apparatus according to claim 1 wherein said cathode ray tube has a radius of curvature greater or equal to 1.5R.

12. A deflection apparatus according to claim 1 wherein said cathode ray tube has a radius of curvature on the order of 3.5R in the horizontal edges.

* * * * *